US011103406B1

(12) United States Patent
Channell et al.

(10) Patent No.: US 11,103,406 B1
(45) Date of Patent: Aug. 31, 2021

(54) AIRBORNE INFECTIOUS DISEASE ISOLATION UNITS AND METHOD OF MAKING USING PREFABRICATED CONTAINERS

(71) Applicant: United States of America as Represented by The Secretary of The Army, Alexandria, VA (US)

(72) Inventors: Michael G Channell, Vicksburg, MS (US); David M Rogillio, Vicksburg, MS (US); Mickey D Blackmon, Vicksburg, MS (US); Brian C Roden, Madison, AL (US); Bryan C Merry, Huntsville, AL (US); David J Braidich, Manassas, VA (US)

(73) Assignee: UNITED STATES of AMERICA AS REPRESENTED BY THE SECRETARY OF THE ARMY, Alexandria, VA (US)

( * ) Notice: Subject to any disclaimer, the term of this patent is extended or adjusted under 35 U.S.C. 154(b) by 0 days.

(21) Appl. No.: 16/993,188

(22) Filed: Aug. 13, 2020

Related U.S. Application Data

(60) Provisional application No. 63/012,044, filed on Apr. 17, 2020.

(51) Int. Cl.
*A61G 10/02* (2006.01)
*E04H 1/12* (2006.01)

(52) U.S. Cl.
CPC ..... *A61G 10/02* (2013.01); *E04H 1/1205* (2013.01); *E04H 2001/1283* (2013.01)

(58) Field of Classification Search
CPC ..... A61G 10/02; E04H 1/1205; E04H 2001/1283
See application file for complete search history.

(56) References Cited

U.S. PATENT DOCUMENTS 6,155,747 A * 12/2000 Payne ..... B09B 3/00 405/129.55
6,179,522 B1 * 1/2001 Sanford ..... B09B 3/00 405/129.55
2007/0132262 A1 * 6/2007 Chui Peng Sun ..... A61G 3/001 296/24.38
2012/0006369 A1 * 1/2012 Cantin ..... E04B 1/3444 135/96

(Continued)

*Primary Examiner* — Gisele D Ford
(74) *Attorney, Agent, or Firm* — Brian C. Jones

(57) ABSTRACT

In one embodiment, a prefabricated container is modified as a medical isolation room by replacing an original door with a clear front door. An intake louver and an adjustable damper are disposed at a lower part of the front end. An exhaust vent is disposed at an upper part of the back wall. An exhaust fan and a HEPA filter are coupled to the exhaust vent. Washable coverings cover interior sides of the container to provide washable, nonslip interior surfaces. The exhaust fan and the adjustable damper at the intake louver are controlled to produce in the medical isolation room a negative air pressure of at least about minus 0.01 inch of water gage (approximately 2.5 pascals) and a displacement ventilation exhaust flow rate through the exhaust vent of at least about 100 cubic feet per minute (cfm) greater than an intake flow rate through the intake louver.

20 Claims, 10 Drawing Sheets

(56) References Cited

U.S. PATENT DOCUMENTS

| | | | | |
|---|---|---|---|---|
| 2012/0077429 | A1* | 3/2012 | Wernimont | F24F 3/167<br>454/187 |
| 2012/0199003 | A1* | 8/2012 | Melikov | F24F 3/163<br>95/273 |
| 2016/0010883 | A1* | 1/2016 | Jornitz | F24F 3/16<br>454/187 |
| 2016/0128886 | A1* | 5/2016 | Merino | A61G 10/005<br>600/21 |
| 2017/0156961 | A1* | 6/2017 | Patel | A61G 10/005 |
| 2017/0328055 | A1* | 11/2017 | Morales | E04B 1/34347 |

* cited by examiner

AIRBORNE INFECTIOUS DISEASE ISOLATION UNITS AND METHOD OF MAKING USING PREFABRICATED CONTAINERS

CROSS-REFERENCE TO RELATED APPLICATIONS

This application claims priority to U.S. Provisional Application 63/012,044, filed Apr. 17, 2020, which is incorporated herein by reference in its entirety.

STATEMENT OF GOVERNMENT INTEREST

The subject matter of this disclosure was supported by the U.S. Department of Energy and the U.S. Army Construction Engineering Research Laboratory. Under paragraph 1(a) of Executive Order 10096, the conditions under which this invention was made entitle the Government of the United States, as represented by the Secretary of the Army, to an undivided interest therein on any patent granted thereon by the United States. This and related patents are available for licensing to qualified licensees.

BACKGROUND

Field of the Invention

The present invention relates to medical care rooms and, more particularly, to medical isolation rooms made by modifying commercially available prefabricated containers, which can be done quickly and inexpensively.

Description of the Related Art

This section introduces aspects that may help facilitate a better understanding of the invention. Accordingly, the statements of this section are to be read in this light and are not to be understood as admissions about what is prior art or what is not prior art.

With COVID-19 pandemic, there is currently an unprecedented need for quick, speedy, efficient, low-cost, and effective infectious disease isolation units to hospitalize, house, contain, treat, and resuscitate COVID-19 patients. Since COVID-19 began in late 2019, as of May 16, 2020, there are confirmed over 4.6 million coronavirus cases in the world with over 310,000 deaths in over 210 countries. In the United States alone, there are currently over 1.5 million confirmed cases and over 88,000 deaths. Asymptomatic cases and unaccounted for deaths will likely push the actual numbers much higher as these figures continue to climb daily.

COVID-19 is caused by severe acute respiratory syndrome coronavirus 2 (SARS-CoV-2). Originating in Wuhan, China, in December 2019, the World Health Organization declared it to be a Public Health Emergency of International Concern on 30 Jan. 2020 and a pandemic on Mar. 11, 2020.

The virus has caused widespread, global stay-home orders, leading to businesses and almost all civic human activities being curtailed or prohibited in unprecedented manner. Global travel has come almost to a stop, and it has caused almost every economy in the world to experience profound distress. Preventative measures include hand washing, using face coverings, physical distancing, and isolation from others.

The virus is transmitted through close contact, or even through droplets spread through coughing, sneezing, or talking, and there is possibility that the virus is airborne and can transmit in close proximity through airborne transfer. It can also transfer through contaminated surfaces such as by touching mucous membranes such as eyes, nose, or mouth. The virus is also known to survive on surfaces for up to 72 hours. Many infected individuals are also asymptomatic with symptoms appearing in only later stages. Symptoms often include fever, cough, dizziness, and shortness of breath, and those with underlying medical conditions such as asthma, prior pneumonia, diabetes, hypertension, and heart conditions have high rate of mortality among the infected, often with the patients dying of respiratory distress and failure.

Because there are no proven vaccine or antiviral mediation for COVID-19, many infected patients end up needing medical care and in many cases intensive medical care. Exploding beyond possible surge capabilities, many impacted cities, and communities deal with shortage of hospital beds, hospital spaces, personnel protection equipment, and key medical equipment such as ventilators, in scope not seen before.

USACE has been in the forefront of converted hospital and medical spaces in enclosed building to handle the surge and overflow of COVID-19 patients, and this invention addresses this pressing need, as well as other times of need for extreme increases in need for quick, low-cost, efficient, and effective airborne infectious disease isolation treatment units.

SUMMARY

The present invention concerns a quick and low-cost method of building airborne infectious isolation units using existing commercially available container units. For example, in most cities, there are commercial companies that deliver ISO style containers for use in storage of human property. In most metropolitan areas throughout the United States, companies have in reserve and have in inventory thousands of containers that can be delivered for storage of property. There are various companies that provide such services for a fee.

Without having to deliver large quantities of containers, such as ISO containers, QuadCon, ConEx type of containers by any individual government agency or company, when there is a need for large quantities of airborne infectious isolation units such as those shown in the attached drawings, thousands of containers can be delivered to any given locations.

The present invention is preferably used in a covered interior space, such as a large warehouse or sporting facility, that would be converted to house such isolation container units. These spaces are preferably as they already have existing utilities, heating, air conditioning, plumbing, and other amenities. Rather than having the entire building be considered "dirty" or infected with airborne coronavirus floating freely around as in other open space type of arrangements, the current invention provides airborne infectious isolation units that contain the COVID-19 virus and other similar airborne diseases to primarily within those units. This allows for medical care personnel to not have to be completely equipped with PPE in every area of the enclosed building, but only within such containment units.

The invention is directed to converting a commercially available prefabricated container (e.g., PODS) into a self-contained infectious isolation treatment unit, sometimes referred to as an airborne infection isolation room (AIIR). At one end, the AIIR unit has a clear door between a pair of clear panels. The room has washable wall interiors and floor coverings. For example, FRP (fiberglass reinforced plastic) wall interiors and floor coverings can be used to allow for sanitary interior surfaces that would be smooth for easy cleaning and decontamination.

In accordance with an aspect of the present invention, a prefabricated container is modified as a medical isolation room, comprising: a prefabricated container having a width, a height, and a length between a front end and a back end, the length being greater than the width, the front end including an original door which is replaced by a clear front door, the container including a base having, a roof, and two side panels along the length, the container including a back wall at the back end along the width and the height; an intake louver and an adjustable damper, located at a lower part of the front end adjacent the base; an exhaust vent located at an upper part of the back wall adjacent to the roof; an exhaust fan coupled to the exhaust vent; a HEPA filter coupled to the exhaust fan; and washable coverings to cover interior sides of the two side panels, the back wall, and the base to provide washable, nonslip interior surfaces. The exhaust fan and the adjustable damper at the intake louver are controlled to produce in the isolation space a negative air pressure of at least minus 0.01 inch of water gage (approximately 2.5 pascals) and a displacement ventilation exhaust flow rate through the exhaust vent of at least about 100 cubic feet per minute (cfm) greater than an intake flow rate through the intake louver.

In some embodiments, the exhaust fan and the adjustable damper of the intake louver are controlled to produce an exhaust air change rate of at least 12 air changes per hour for the medical isolation room. The exhaust fan and the adjustable damper of the intake louver are controlled to produce a displacement ventilation flow rate through the exhaust vent of at least about 200 cubic feet per minute (cfm).

In specific embodiments, the front end includes a clear front panel disposed adjacent the clear door and the intake louver is provided at a lower part of the clear front panel adjacent the base. The intake louver is disposed less than about 12 inches above a floor surface of the base. The exhaust vent is disposed less than about 12 inches below a ceiling of the roof. The prefabricated container has a width of about 8 feet, a height of about 8 feet, and a length of about 12-16 feet. The intake louver has a width of about 12 inches and a height of about 12 inches.

In some embodiments, the washable coverings to cover the interior sides of the two side panels, the back wall, and the base comprise spray-on or sheeting including FRP (fiberglass reinforced plastic), HDPE (high-density polyethylene), rubber, rolled vinyl, or aluminum.

In specific embodiments, an access ramp disposed in front of the clear front door and including an inclined ramp surface extending from a ground below a floor surface of the base to the floor surface in front of the clear front door.

In some embodiments, a plurality of medical isolation rooms are arranged side-to-side with the clear front doors all facing in a same direction and all aligned to be coplanar with each other to achieve direct line-of-site from the healthcare provider.

In accordance with another aspect of this invention, a prefabricated container is modified as a medical isolation room, comprising: a prefabricated container having a width, a height, and a length between a front end and a back end, the length being greater than the width, the front end including an original door which is replaced by a clear front door, the container including a base, a roof, and two side panels along the length, the container including a back wall at the back end along the width and the height; an intake louver and an adjustable damper, disposed at a lower part of the front end adjacent the base; an exhaust vent disposed at an upper part of the back wall adjacent the roof; an exhaust fan coupled to the exhaust vent; a HEPA filter coupled to the exhaust fan; and washable coverings to cover interior sides of the two side panels, the back wall, and the base to provide washable, nonslip interior surfaces. The exhaust fan and the adjustable damper at the intake louver are controlled to produce in the medical isolation room a negative air pressure of at least minus 0.01 inch of water gage (approximately 2.5 pascals) and a displacement ventilation exhaust flow rate through the exhaust vent of at least about 100 cubic feet per minute (cfm) greater than an intake flow rate through the intake louver. The displacement ventilation exhaust flow rate through the exhaust vent is at least about 200 cfm. The exhaust fan and the adjustable damper at the intake louver are controlled to produce an exhaust air change rate of at least 12 air changes per hour for the medical isolation room.

In accordance with yet another aspect of this invention, a method of making a medical isolation room using a prefabricated container comprises: installing a clear front door in a prefabricated container having a width, a height, and a length between a front end and a back end, the length being greater than the width, the front end including an original door which is replaced by the clear front door, the container including a base, a roof, and two side panels along the length, the container including a back wall at the back end along the width and height; installing an intake louver and an adjustable damper, disposed at a lower part of the front end adjacent the base; installing an exhaust vent disposed at an upper part of the back wall adjacent the roof; coupling an exhaust fan to the exhaust vent; coupling a HEPA filter to the exhaust fan; and covering, with washable coverings, interior sides of the two side panels, the back wall, and the base to provide washable, nonslip interior surfaces; and controlling the exhaust fan and the adjustable damper at the intake louver to produce in the medical isolation room a negative air pressure of at least minus 0.01 inch of water gage (approximately 2.5 pascals) and a displacement ventilation exhaust flow rate through the exhaust vent of at least about 100 cubic feet per minute (cfm) greater than an intake flow rate through the intake louver.

In some embodiments, the method further comprises controlling the exhaust fan and the adjustable damper at the intake louver to produce an exhaust air change rate of at least 12 air changes per hour for the medical isolation room. The method further comprises controlling the exhaust fan and the adjustable damper of the intake louver to produce a displacement ventilation flow rate through the exhaust vent of at least about 200 cubic feet per minute (cfm).

In specific embodiments, the method further comprises arranging a plurality of the medical isolation rooms side-to-side with the clear front doors all facing in a same front direction and all aligned to be coplanar with each other.

In some embodiments, the method further comprises arranging the plurality of the medical isolation rooms side-to-side with the back walls all facing in a same back direction and all aligned to be coplanar with each other; and connecting utilities to the plurality of medical isolation rooms to share utilities among at least some of the medical isolation rooms, the shared utilities including one or more of HVAC, electrical, and power generation.

In specific embodiments, the method further comprises: installing at the front end a clear front panel disposed adjacent the clear front door; installing the intake louver at a lower part of the clear front panel less than about 12 inches above a floor surface of the base; and installing the exhaust vent less than about 12 inches below a ceiling of the roof.

BRIEF DESCRIPTION OF THE DRAWINGS

Embodiments of the invention will become more fully apparent from the following detailed description, the appended claims, and the accompanying drawings in which like reference numerals identify similar or identical elements.

DETAILED DESCRIPTION

Detailed illustrative embodiments of the present invention are disclosed herein. However, specific structural and functional details disclosed herein are merely representative for purposes of describing example embodiments of the present invention. The present invention may be embodied in many alternate forms and should not be construed as limited to only the embodiments set forth herein. Further, the terminology used herein is for the purpose of describing particular embodiments only and is not intended to be limiting of example embodiments of the invention.

As used herein, the singular forms "a," "an," and "the," are intended to include the plural forms as well, unless the context clearly indicates otherwise. It further will be understood that the terms "comprises," "comprising," "includes," and/or "including," specify the presence of stated features, steps, or components, but do not preclude the presence or addition of one or more other features, steps, or components. It also should be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Figure 1:
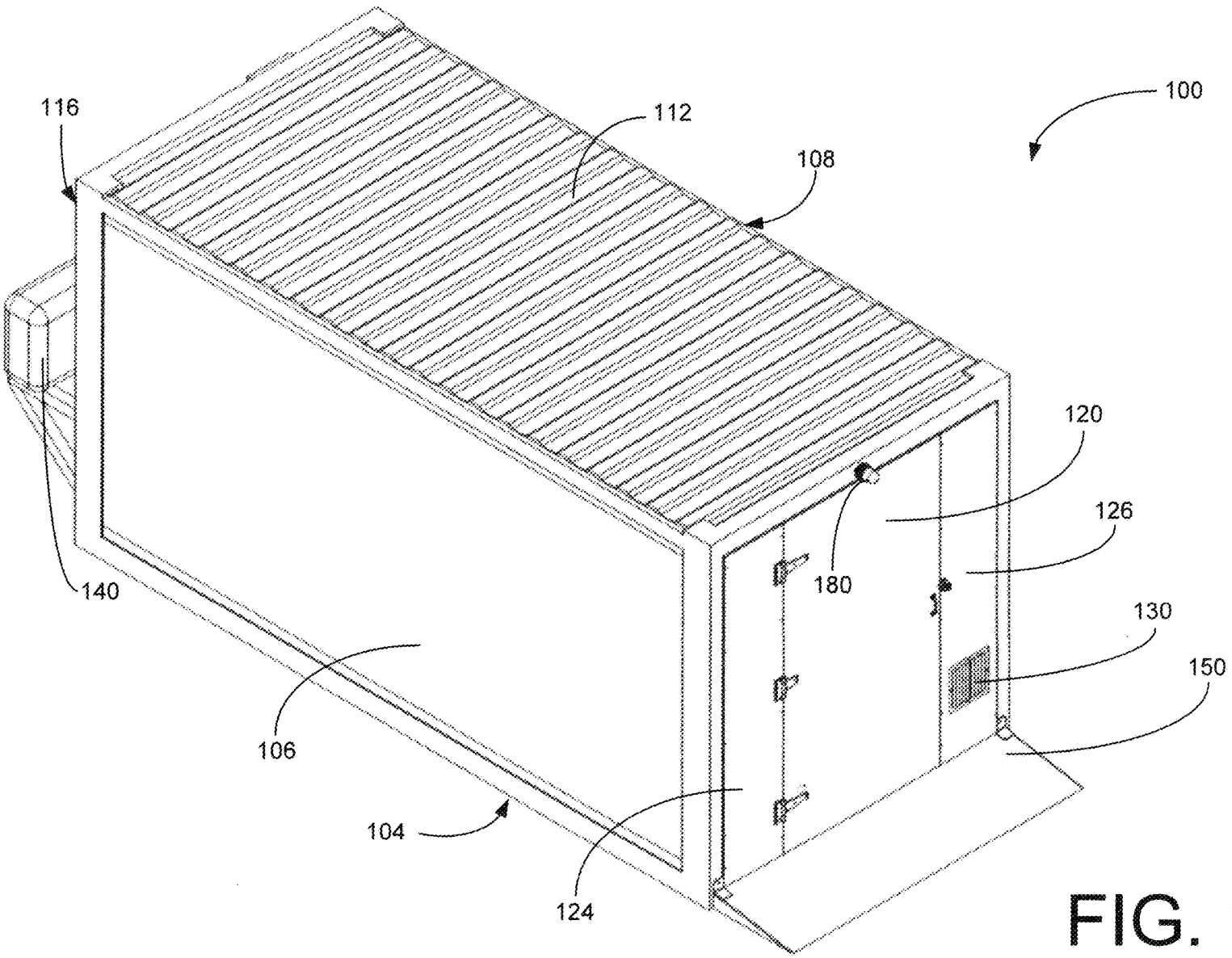
FIG. 1 is a perspective view of a container medical isolation unit according to an embodiment of the present invention.
Figure 2:
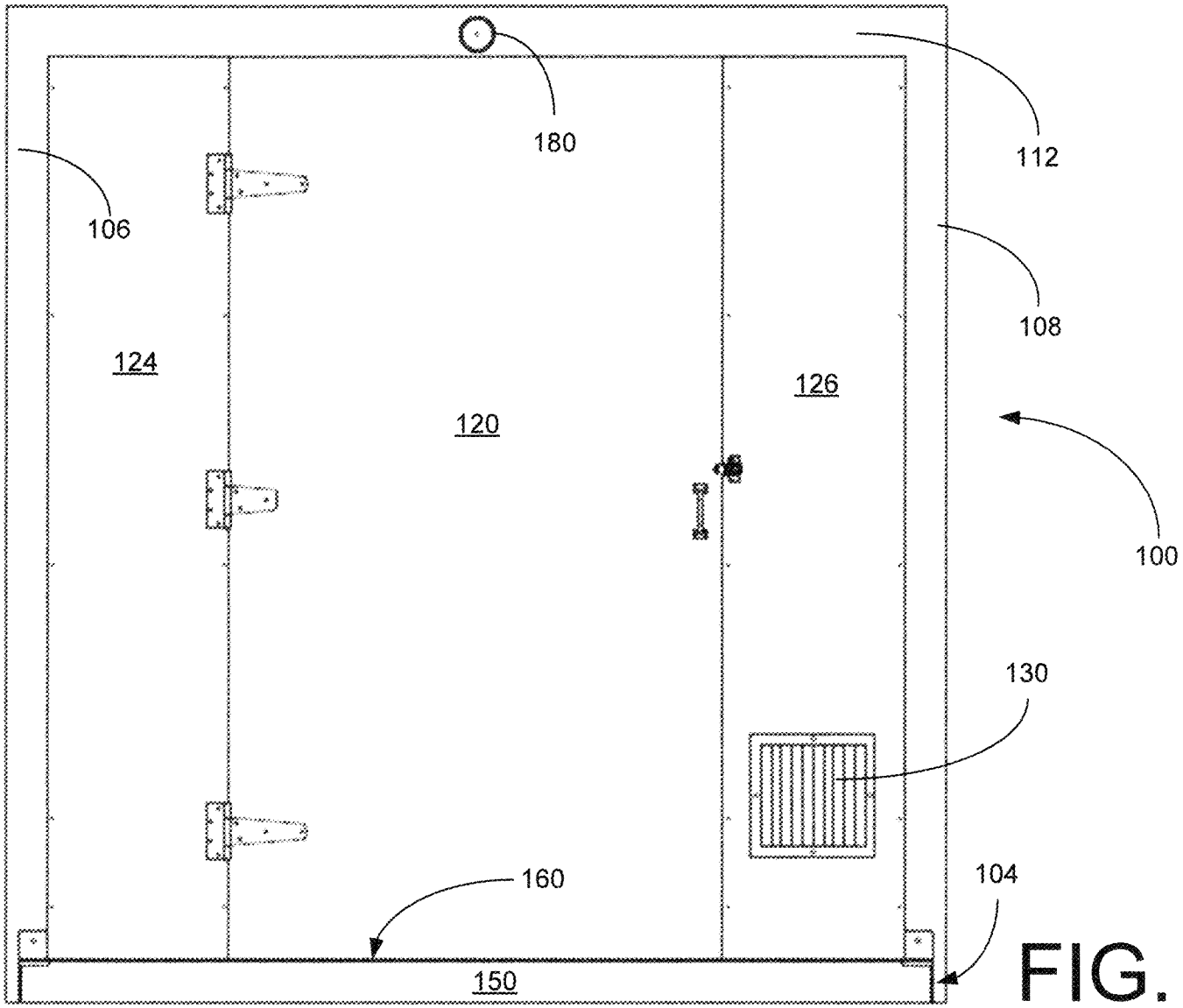
FIG. 2 is a front elevational view of the container isolation unit of FIG. 1.
Figure 3:
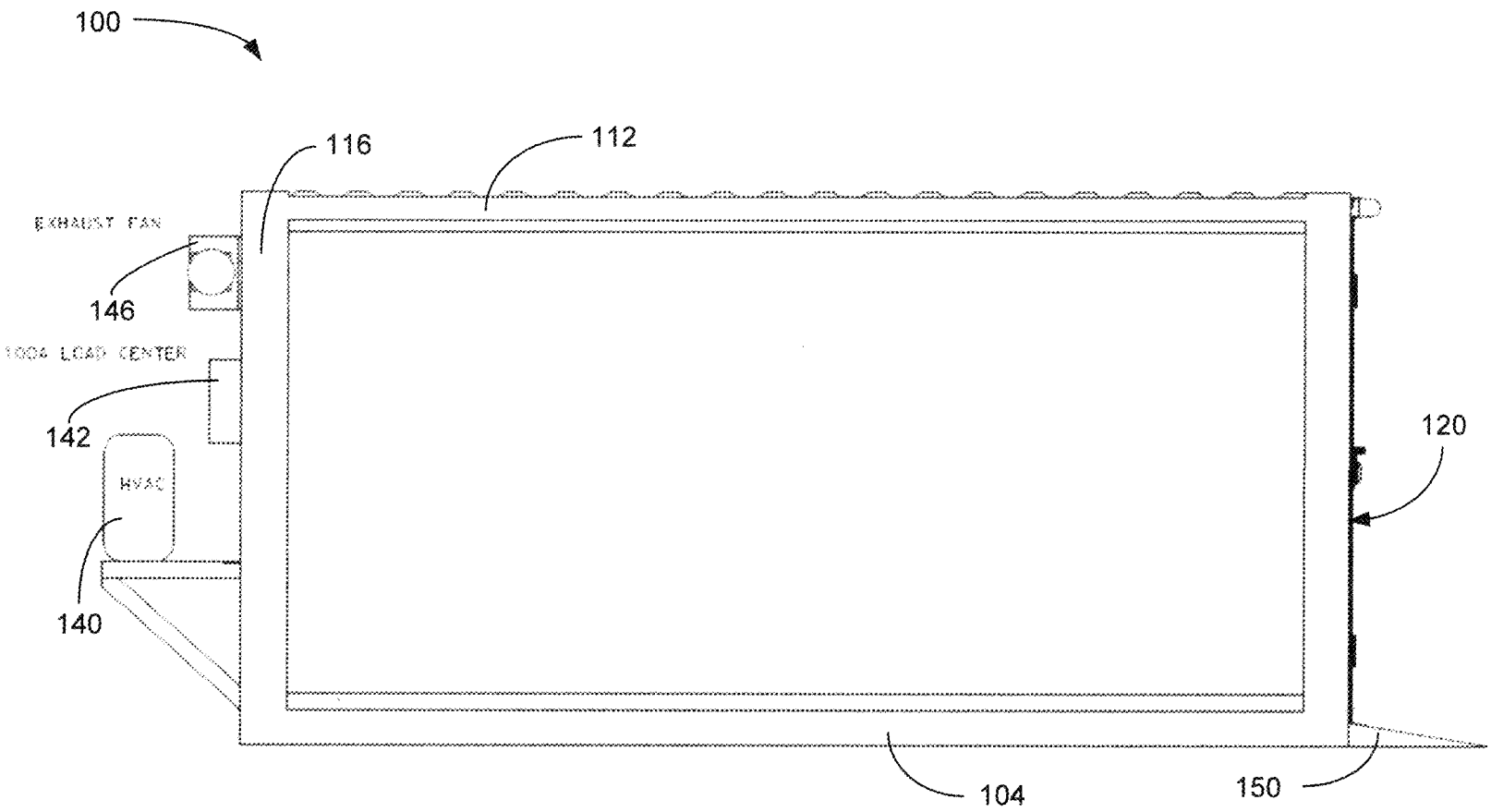
FIG. 3 is a side elevational view of the container isolation unit of FIG. 1.
Figure 4:
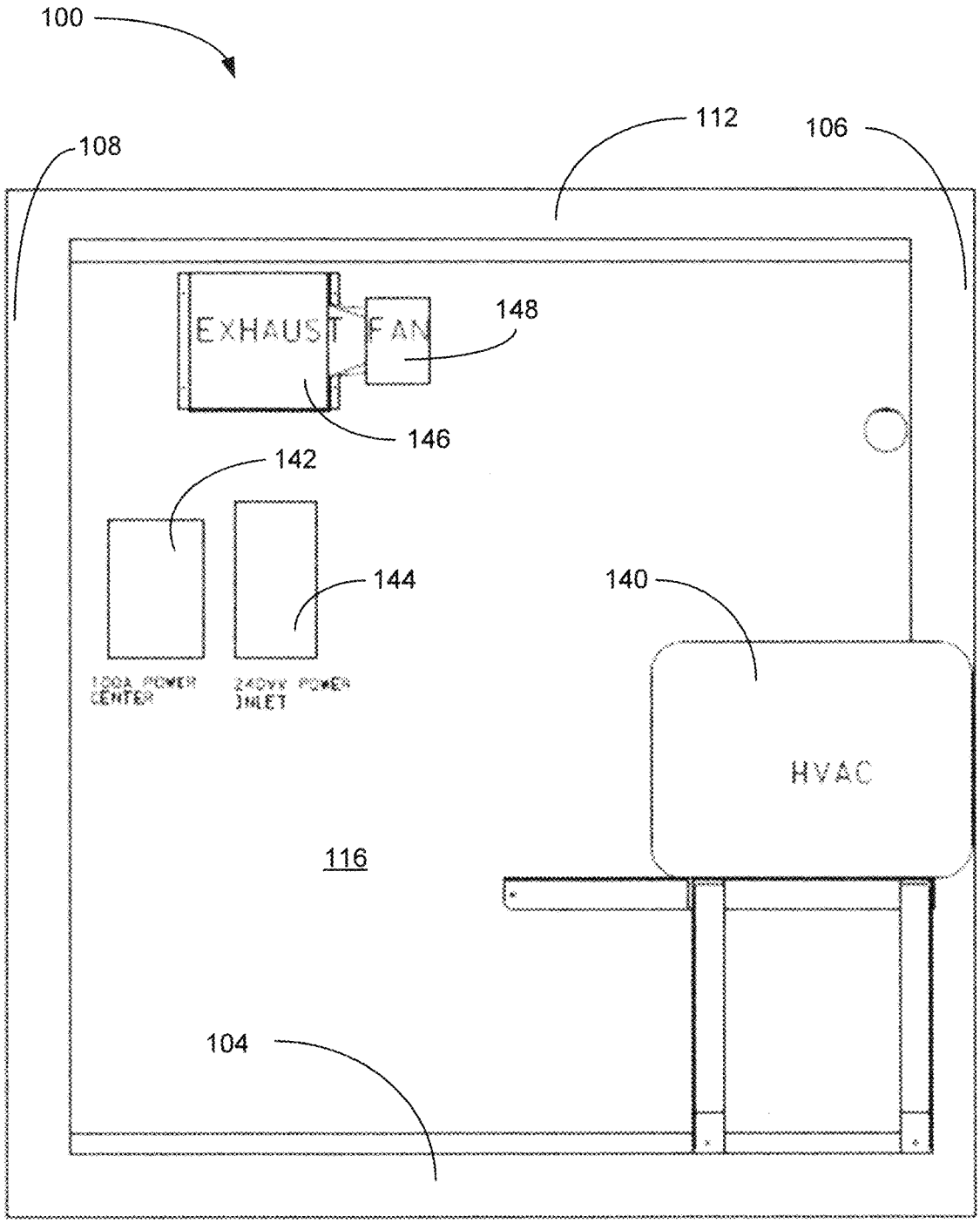
FIG. 4 is a back elevational view of the container isolation unit of FIG. 1.

FIG. 1 is a perspective view of a container medical isolation unit according to an embodiment of the present invention. FIG. 2 is a front elevational view of the container isolation unit of FIG. 1. FIG. 3 is a side elevational view of the container isolation unit of FIG. 1. FIG. 4 is a back elevational view of the container isolation unit of FIG. 1.

The isolation unit 100 has the shape of a typical rectangular prefabricated container. It has a base or floor 104, two side walls 106, 108, a roof or top 112, a back wall 116, and a front door 120. The base 104 has a floor surface facing up in the interior of the room. The roof has a ceiling facing down in the interior of the room. In the embodiment shown, the front door 120 is a clear hinged door disposed between two clear front panels 124, 126. In a different embodiment, the front door is a sliding door that slides relative to a clear front panel of the same or larger size. The container unit 100 is typically made of metal such as steel, or corrugated fiberglass, or the like. The clear door 120 and panels 124, 126 may be made of glass, plexiglass, or the like. A louver and damper unit 130 is provided at the front panel 126 and located near or adjacent the base 104. Disposed behind the back wall 116 are a HVAC unit 140, a 100-Amp circuit main breaker load center 142 for a power generator, a 240V power inlet 144 for electricity supply, an exhaust fan 146, and a HEPA filter 148. The HVAC unit 140 may be a heat pump.

The base panel or structure has a thickness of a few inches so that the floor surface 160 is a few inches above the ground on which the isolation unit 100 is placed. An access ramp 150 is provided in front of the front door to make it handicapped accessible. The access ramp is disposed in front of the clear front door 120 and includes an inclined ramp surface extending from a ground below a floor surface of the base 104 to the floor surface in front of the clear front door 120. The ramp 150 has an angle of about 8-10° relative to the ground depending on the height of the floor surface 160 from the ground. The access ramp 150 may be constructed of aluminum sheet metal. It is typically manufactured in advance and added on to the container on-site as a field-modified feature.

As best seen in the front elevational view of FIG. 2 and the side elevational view of FIG. 3, the front end of the isolation unit 100 has a dimension of about 8'×8' and the side has a length of about 12'-16'. The hinged door 120 has a width of about 4' and a height of about 7.5'. The door hinge is typically self-closing. A door snap arm latch may be provided for the door. The louver and damper unit 130 has a width of about 12" and a height of about 12". Its lower edge is disposed about 12" above the floor surface 160. A base-mount flashing signal light 180 is provided above the front door 120 for emergency notification. The signal light 180 may be activated by a patient call pendant or some other button close to the patient's bed.

As seen in the back elevational view of FIG. 4, connected downstream of the exhaust fan 146 is the HEPA filter 148. The exhaust fan 146 is disposed just below the ceiling of the roof panel 112. The arrangement of the exhaust fan 146, HEPA filter 148, 100-A load center 142, and 240V power inlet 144 may vary in other embodiments. For example, the HEPA filter 148 may be disposed upstream of the exhaust fan 146 instead of downstream.

Figure 5:
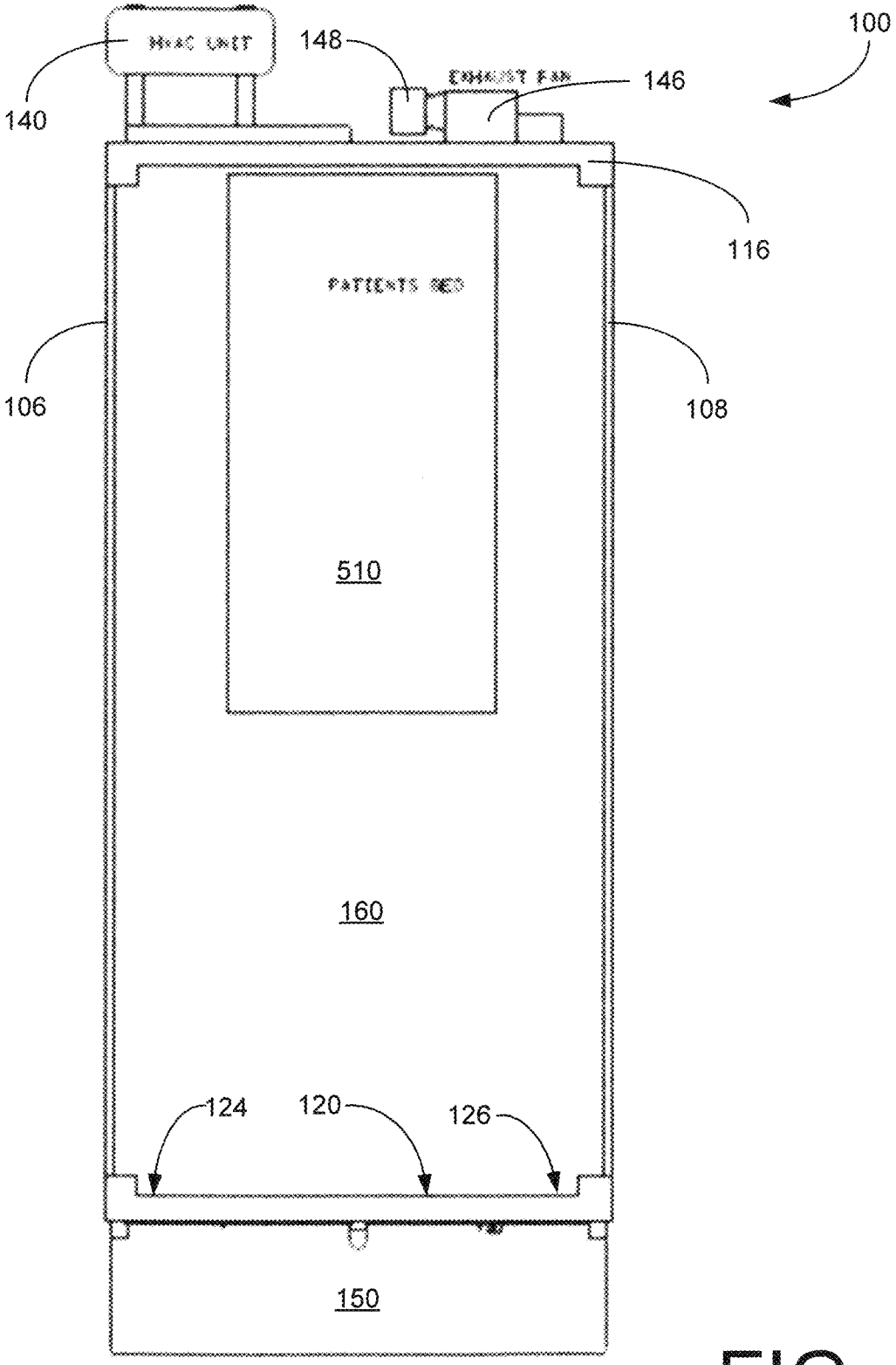
FIG. 5 is a top view showing an interior of the container isolation unit of FIG. 1.

FIG. 5 is a top view showing an interior of the container isolation unit of FIG. 1. A bed 510 is disposed near to the back wall 116 to position the head of the patient close to the back wall 116 and the feet of the patient oriented in the direction of the front door 120.

Figure 6:
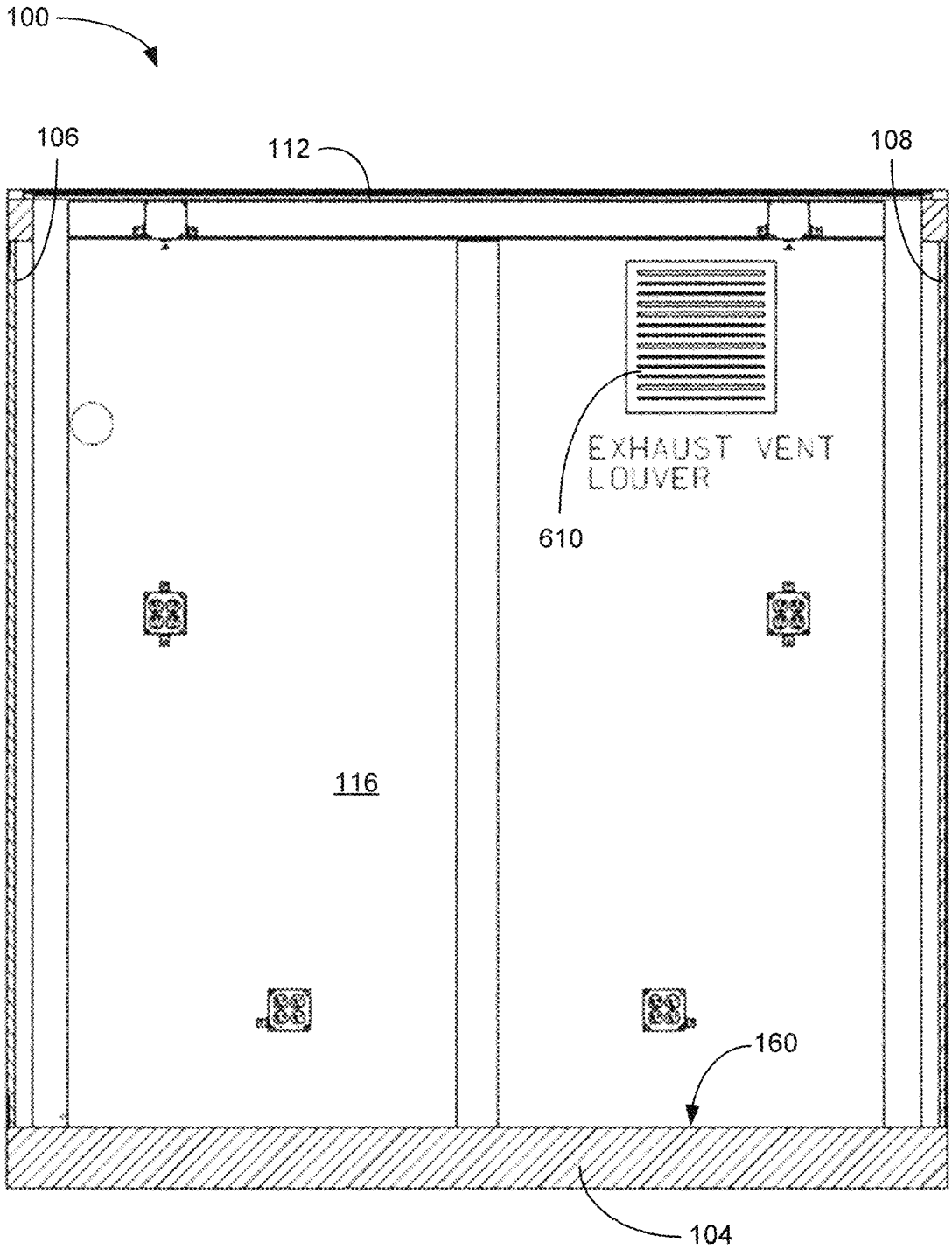
FIG. 6 is a sectional view of the container isolation unit of FIG. 1 showing an interior view of the back wall.

FIG. 6 is a sectional view of the container isolation unit of FIG. 1 showing an interior view of the back wall. An exhaust vent louver 610 is disposed on the back wall 116 above the bed 510 and is coupled with the exhaust fan 146. The exhaust vent 610 is disposed just below the ceiling of the roof panel 112. In one example, the exhaust vent has a width of about 12" and a height of about 12" and its lower edge is disposed less than about 18" below the ceiling of the roof 112. A plurality of power outlets are conveniently provided on the back wall 116 to supply power to a variety of medical equipment, machines, lights, and the like next to the bed 510. A patient call pendant may be provided on the back wall 116 close to the bed 510.

Clear Front Door and Panels

An embodiment of the current invention contemplates removing one wall of a commercially available container (which usually has a roll up type door or a hinged door) and replacing such removed wall with the clear, see-through door 120 and panels 124, 126. This modification meets the clinical requirement or recommendation of providing observation glass, whereby medical workers can view the interior of the room without having to open a door or a window. This increases the effectiveness of medical personnel, especially in emergency situations where the medical personnel number can be limited. It aids in allowing for limited staff to be able to assess patient condition and situation more easily from the outside.

The see-through doors and panels can be manufactured in advance in large quantities and installed on site using ½" plexiglass material or the like, for example, to provide direct line of sight to medical professionals. In addition to meeting this much needed goal of visibility in such circumstances, these doors and panels are easily installed, for example, by bolting the walls directly onto the container using, for example, silicon and bolts into holes directly drilled on the spot into the container. This is a way to provide a field-modified isolation room entry door 120 and panels 124, 126, which are ideal for healthcare isolation environments that require both high hygiene and maximum space. The transparency offered by the clear door 120 and panels 124, 126 makes it easier to monitor patients from outside the room and prevent cross contamination.

Wall Interiors and Floor Coverings

Wall coverings and/or floor coverings can be used inside the isolation room to provide sanitary interior surfaces that would be smooth for easy cleaning and decontamination. Coverings may include sheeting or panel made of FRP (fiberglass reinforced plastic), HDPE (high-density polyethylene), rubber, rolled vinyl, or aluminum. Another approach involves the use of spray-on such as PROSOCO R-Guard spray wrap MVP, Securock ExoAir 430, or SealTight AirShield LM. The coverings have the ability to be seamless (e.g., over welded seams) and be washable and cleanable while maintaining safe, non-slip surfaces. The floor and wall surfaces are sealed and made smooth for easy cleaning. In addition, the ceiling at the top 112 includes a gasketed ceiling grid for a proper seal and smooth and easy to clean ceiling tiles.

Displacement Type Ventilation

Efficient ventilation in airborne isolation rooms is important insomuch as it decreases the risk of cross infection. It can also reduce energy consumption. The ventilation used in embodiments of the current invention uses a displacement type of ventilation where air is drawn into the unit at one end and air is exhausted at another end, rather than fully ducted supply and return type of ventilation that would be more complex and expensive, for example. The displacement ventilation approach in airborne infection isolation rooms focuses on reducing or eliminating health care worker exposure to pathogens exhaled by infected patients.

There is an increased or improved air quality effect in that the drawing in of air from one end with air being exhausted out at the other end acts in a piston-like manner, where the resulting effect is a lower air temperature than expected without the need of a separate stand-alone temperature control or heating/cooling unit. Dedicated heating or cooling unit may not be needed based on the positioning of the inflow/intake port as opposed to the outflow/outtake port. In addition to the effect of the flow of air from one longitudinal end of the container to the other, based on the positioning of the inflow and outflow ports on the opposing ends of the container, the interior temperature can be controlled to decrease the internal temperature of the container relative to the overall ambient temperature surrounding the unit. For example, with the intake port located lower on a wall and the outtake port located higher on the opposing wall, cooler external air is drawn in with warmer internal air being displace, resulting in relative cooling of the container interior. The HVAC unit 140 is used to provide additional cooling or to provide heating to achieve a desired interior temperature range (e.g., 68-72° F.). In the specific embodiment as illustrated in FIGS. 1-6, the isolation room 100 employs displacement ventilation generated by the intake louver with damper control 130 for air intake at the front panel 126 about 12" above the floor surface 160 and the exhaust vent 610 for air exhaust disposed at the back wall 116 about 18" below the roof 112.

Exhaust Fan with HEPA Filter

Exhaust from the isolation unit 100 should be either directly discharged to the outside or, as shown in FIGS. 1-6, filtered through the HEPA filter 148 before being returned to a tented space or building interior space. Various HEPA filter and fan configurations may be utilized including fan filter units (FFU's), negative air machines, or centralized exhaust. HEPA filters are required to meet IEST RP-CC-001. Prefilters upstream of the HEPA filters may be used where feasible to minimize HEPA filter replacement.

If exhaust air is to be discharged to the outside of the tent without HEPA filtering, the exhaust fan shall be located as close to the building exterior as possible to minimize any positively pressurized duct within the building, and the discharge should be a minimum of about 25 feet away from air intakes, doors, operable windows, other building openings, and any areas normally accessible to the staff or public. Where short runs of positively pressurized duct need to be within the building, they should be sealed in accordance with SMACNA duct leakage Seal Class A. On the other hand, if exhaust air is to be HEPA filtered and returned to the space, the design should account for the additional fan heat.

Louver and Damper Unit Maintaining Negative Air Pressure Inside Container

In the infectious airborne disease isolation medical container unit 100, the displacement ventilation approach provides negative pressure inside the container as compared to the exterior of the container. The exhaust fan 146 coupled to the exhaust vent 610 draws an airflow from the room. By installing a louver in the intake/inflow port of air flow into the container, the flow of air into the container is controlled using a damper to create a negative air pressure condition. In specific embodiments, a manual balancing damper is used.

Figure 7B:
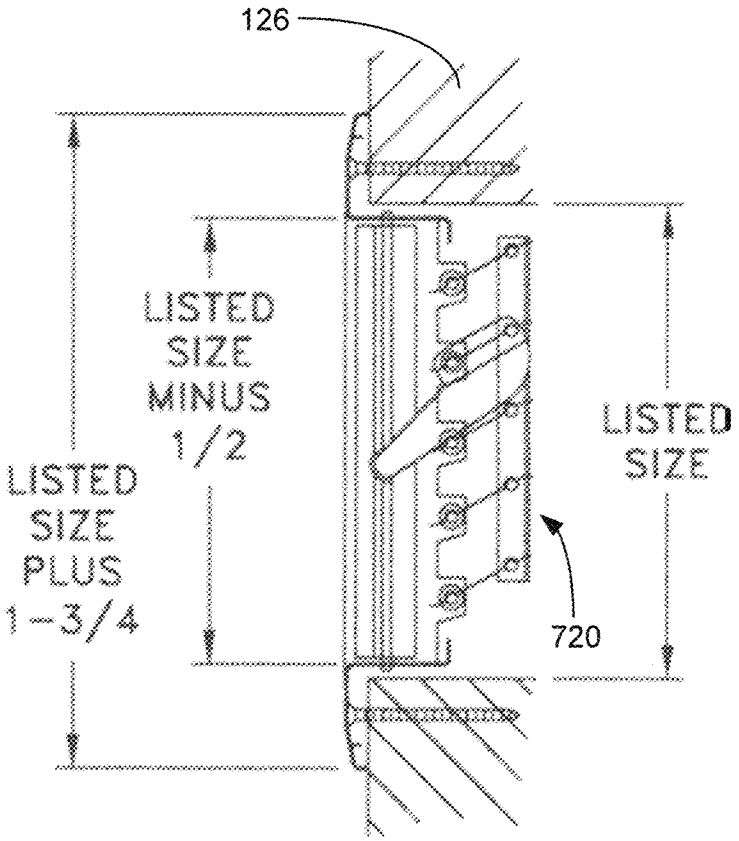
FIG. 7B is a side elevational view thereof.
Figure 7A:
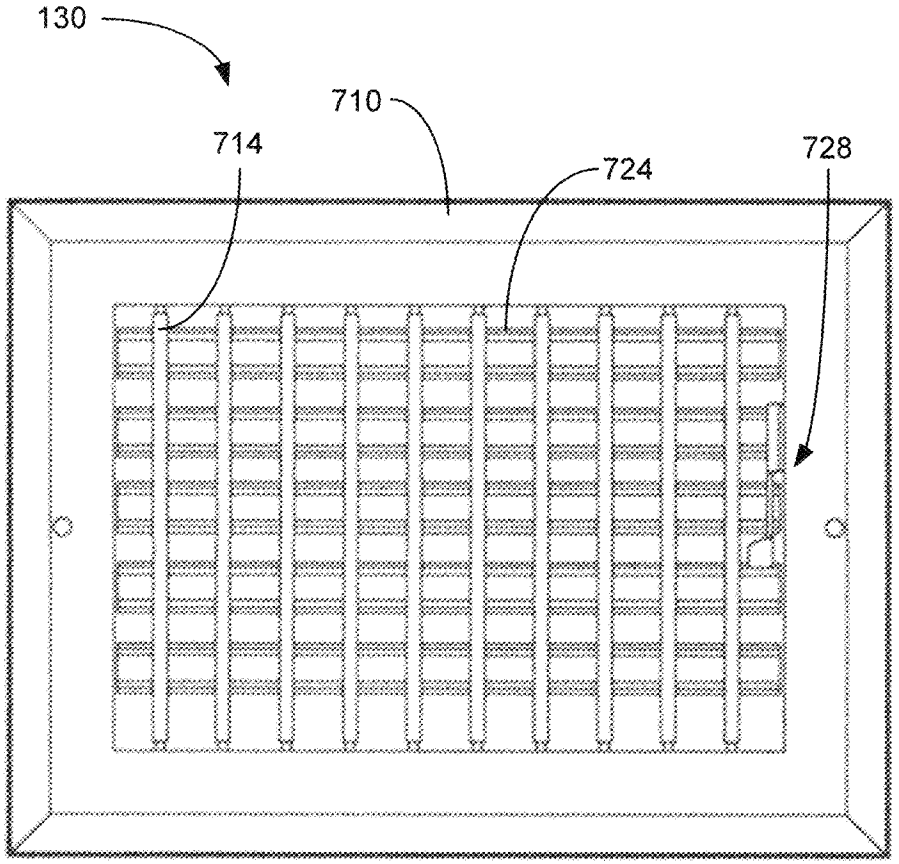
FIG. 7A is a front elevational view of an example of a louver and damper unit viewed from the exterior of the container isolation unit.
Figure 7C:
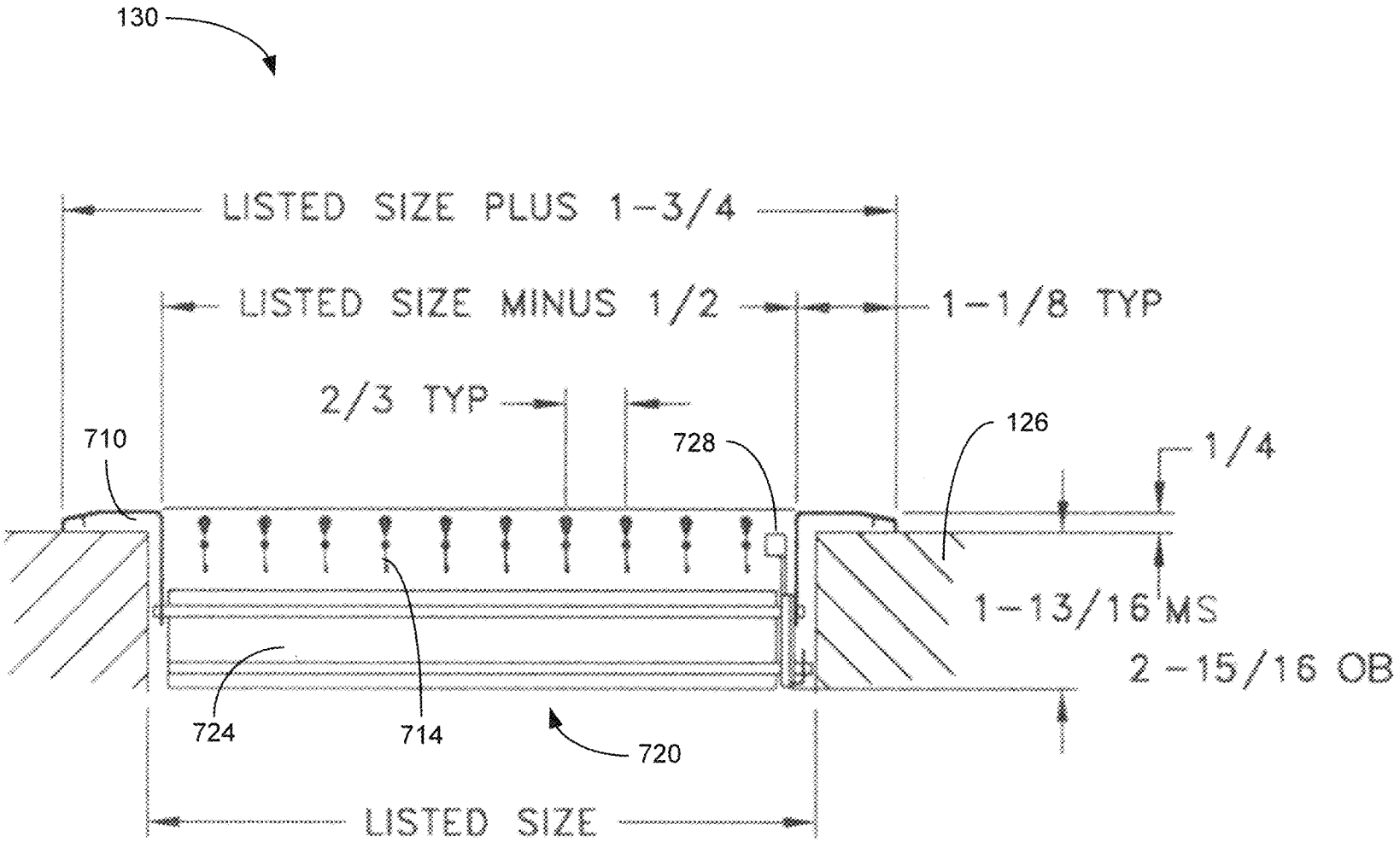
FIG. 7C is a bottom elevational view thereof.

FIG. 7A is a front elevational view of an example of a louver and damper unit viewed from the exterior of the container isolation unit. FIG. 7B is a side elevational view thereof. FIG. 7C is a bottom elevational view thereof.

The louver and damper unit 130 includes a louver 710 installed in the front panel 126. It has a plurality of vertical support members 714 spaced apart to allow air flow through openings between the vertical support members 714. A damper 720 is provided on an interior side of the louver 710 and includes a plurality of horizontal damper blades 724. A damper control lever 728 controls an angle of the damper blades 724 by rotation so that they are always parallel to each other. Therefore, at any partially open position, the damper blades 724 redirect airflow and control the air pressure inside the container 100, for a given exhaust fan speed of the exhaust fan 146, which can also be adjustable to control the air pressure. The damper lever 728 in this embodiment is manually controlled.

According to certain health medical standards (e.g., AHSRAE 170), a negative air pressure of minus 0.01-inch water gauge (in. w.g.) or approximately 2.5 pascals (Pa) of negative air pressure needs to be maintained. By adjusting the damper control mechanism 728 in the intake louver 710 and using a pressure meter, the target negative pressure is maintained in the container to ensure a clean to dirty air flow path. The HEPA filter 148 serves as a negative pressure air scrubber. In a specific example, a visual negative pressure indicator is provided, which may be a mechanical style (e.g. ball-in-tube style) indicator. The pressure reading is used as feedback to control the speed of the exhaust fan 146 and the angle of the damper blades 724, typically manually.

In some embodiments, the displacement ventilation system has an air change rate of at least six air changes per hour but not less than 100 cfm (cubic feet per minute) greater at the exhaust than at the supply air intake to ensure space pressurization is maintained. One example of a target flow rate of air within the container is approximately 200 cubic feet per minute through the exhaust vent 610. Placement of the exhaust grill 610 and transfer air louver 710 are arranged to achieve displacement style ventilation with the exhaust located at the back wall 116 above the patient's bed 510 and the transfer air inlet louver 130 located at the front end about 12" above the finished floor 160. The transfer air intake louver 710 is provided with the damper 720 that is adjustable/lockable to facilitate TAB (testing and balancing) ensuring both minimum air changes and the required isolation room space pressurization are met.

Customization/Equipping Containers

Each container 100 can contain various customization and items needed for medical unit/room configuration including but not limited to the following: emergency back-up power, electrical and data outlets, headwalls for each isolation patient room sized for the full width and height of back wall 116 for the installation of electrical outlets, data outlets, equipment, and optional wall mounted light fixture and mechanical ductwork (support).

The electrical system may be installed to meet the requirement for the COVID19 emergency under NFPA 70 article 590, Temporary Installations, noting article 517, Healthcare. The generator may be configured as a second service as allowed by NFPA 70 article 230.2A, for "special conditions". Normal power may be generated on site. Enclosures shall be grounded. The emergency generator may be an NFPA 110, type 10, level 1, emergency generator on a flatbed or on pad with skid mounted tank with sufficient fuel supply to maintain continuous operation of generator for 24 hours before refueling. The container may be provided with an exterior switchboard with automatic transfer switches, which is connected to generator power and site normal power to create an NFPA 99, type 2, essential electrical system.

Additional features may include ventilator capable storage cabinet, telemetry/pump on IV stand, stool, over bed table, mobile workstation, linen hamper, sharps/gloves, hand sanitizer station, infectious waste, patient toilet (e.g., self-contained toilets, 5-6 gallon capacity), and patient sink. These elements can be customized, and other known configurations and customizations can be added as desired.

Modular Prefabricated Containers and Arrangements

Figure 8A:
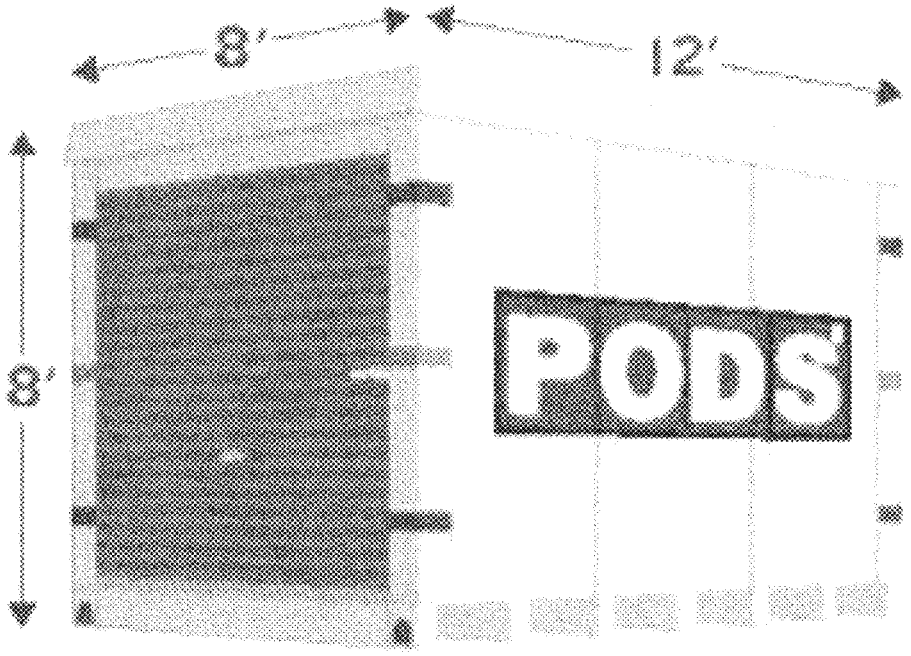
FIG. 8A shows a first example of a prefabrication container that can be modified to create a container medical isolation unit according to an embodiment of the invention.
Figure 8B:
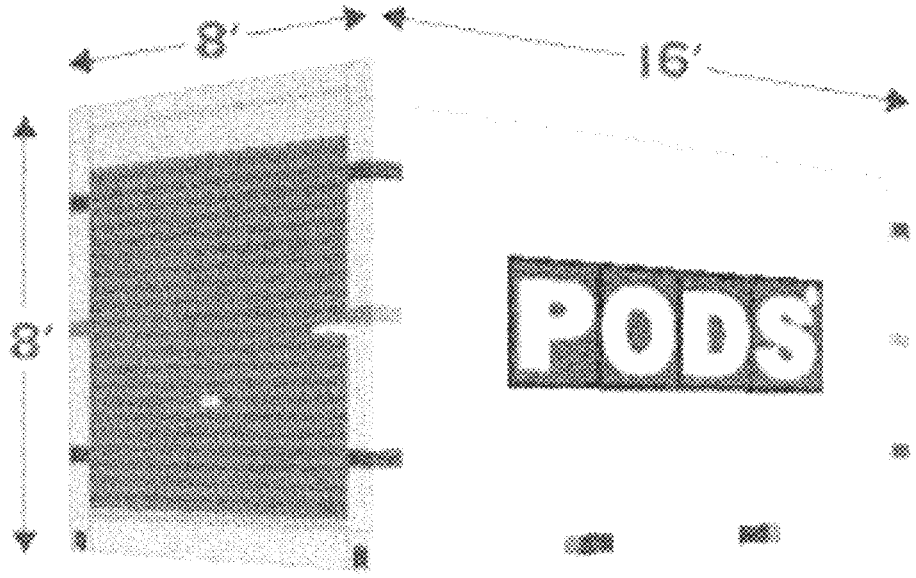
FIG. 8B shows a second example thereof.

FIG. 8A shows a first example of a prefabricated container that can be modified to create a container medical isolation unit according to an embodiment of the invention. FIG. 8B shows a second example thereof. The first example is 8'×8'×12' and the second example is 8'×8'×16. Both are commercially available PODS units. The prefabricated container is modified to have the features described above, including replacement of the roll up type door in the front by the glass door 120 and front panels 124, 126. All materials and finishes inside the container isolation unit 100 shall be suitable for use in a medical facility.

Figure 9:
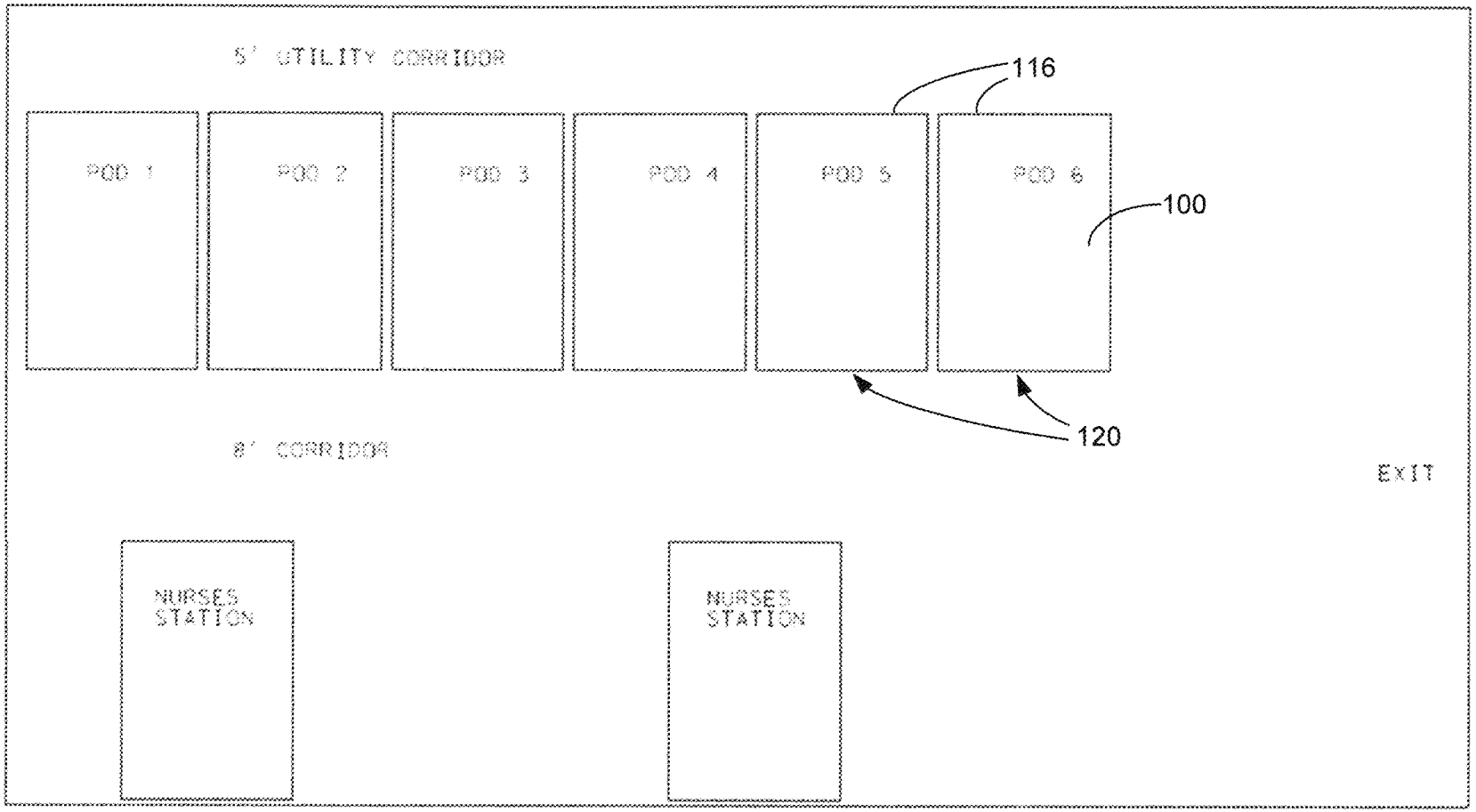
FIG. 9 is a schematic view showing an example of arranging a group of interlocking modular container isolation units.

FIG. 9 is a schematic view showing an example of arranging a group of interlocking modular container isolation units. These modified containers 100 can be arranged side-to-side so that all the see-through doors 120 at the front ends can be placed side-to-side facing the nurse's station(s), to provide full visibility of each patient isolation unit 100 from the nurse's station location. The front doors 120 are shown all aligned to be coplanar with each other and face the front direction. For containers of the same size, the back walls 116 are also aligned to be coplanar with each other and face the back direction. The container units can also be configured to facilitate sharing of utilities such as pumps, HVAC 140, electrical 144, power generation 142, and other utilities as shown or otherwise arranged as needed or desired (i.e., multiple units sharing a common pump, HVAC, electrical, power generation, and other utilities sources/components). The alignment of the back walls of the containers facilitates the sharing of utilities. The utilities are connected to the plurality of medical isolation rooms to share utilities among at least some of the medical isolation rooms.

In specific embodiments, the space shall serve as an Alternate Care Site (ACS) serving COVID-19 with isolation rooms 100 in a suite configuration for acute care COVID-19 patients. The space is considered to be Category 2 "Plus," which is defined as NFPA 99 Category 2 (patient care "activities, systems, or equipment whose failure is likely to cause minor injury of patients, staff, or visitors") (Reference NFPA 99 para. 4.1.2) PLUS additional Category 1 provisions (Critical Care—risk of major injury or death) as relates to the specific needs of a COVID-positive patient on the ventilator (NFPA 99 para. 4.1.). Such an Alternate Care Site (ACS) would act as a temporary satellite Ward supported by a nearby full-service hospital. For example, the isolation units 100 are located inside a large commercial party/event tent which is provided with air conditioning (maintain a temperature of about 68-72° F.) and ventilation, lighting, barriers around tent perimeter, and fire mitigation measures (smoke detection and fire extinguishers).

The layout of the isolation units 100 is designed to maximize patient density while maintaining ingress/egress requirements, NFPA 101 Life Safety Code Requirements, patient access, and visibility requirements, and to ensure that temporary/portable support facilities can be maintained in close proximity to the patient zone. The minimum corridor/walkway widths are typically 8 feet. These patient care modules can be aligned/configured/arranged in rows or larger groupings to create multiple and larger capacity patient care. The modular container isolation units may be interlocked or otherwise interconnected.

The isolation units 100 can be fabricated and organized in a warehouse for efficient setup. This method allows for an assembly line approach, thereby increasing productivity. It allows for continuous fabrication with simultaneous setup. The units can be delivered and set up with the use of a flatbed truck with hoist/crane to reduce manhandling panels.

As will be appreciated by one of ordinary skill in the art, the present invention may be embodied as an apparatus (including, for example, a system, a machine, a device, and/or the like), as a method (including, for example, a business process, and/or the like), or as any combination of the foregoing.

Embodiments of the invention can be manifest in the form of methods and apparatuses for practicing those methods.

Unless explicitly stated otherwise, each numerical value and range should be interpreted as being approximate as if the word "about" or "approximately" preceded the value or range.

Unless otherwise indicated, all numbers expressing quantities of ingredients, properties such as molecular weight, percent, ratio, reaction conditions, and so forth used in the specification and claims are to be understood as being modified in all instances by the term "about," whether or not the term "about" is present. Accordingly, unless indicated to the contrary, the numerical parameters set forth in the specification and claims are approximations that may vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements.

It will be further understood that various changes in the details, materials, and arrangements of the parts which have been described and illustrated in order to explain embodiments of this invention may be made by those skilled in the art without departing from embodiments of the invention encompassed by the following claims.

In this specification including any claims, the term "each" may be used to refer to one or more specified characteristics of a plurality of previously recited elements or steps. When used with the open-ended term "comprising," the recitation of the term "each" does not exclude additional, unrecited elements or steps. Thus, it will be understood that an apparatus may have additional, unrecited elements and a method may have additional, unrecited steps, where the additional, unrecited elements or steps do not have the one or more specified characteristics.

It should be understood that the steps of the exemplary methods set forth herein are not necessarily required to be performed in the order described, and the order of the steps of such methods should be understood to be merely exemplary. Likewise, additional steps may be included in such methods, and certain steps may be omitted or combined, in methods consistent with various embodiments of the invention.

Although the elements in the following method claims, if any, are recited in a particular sequence with corresponding labeling, unless the claim recitations otherwise imply a particular sequence for implementing some or all of those elements, those elements are not necessarily intended to be limited to being implemented in that particular sequence.

All documents mentioned herein are hereby incorporated by reference in their entirety or alternatively to provide the disclosure for which they were specifically relied upon.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments. The same applies to the term "implementation."

The embodiments covered by the claims in this application are limited to embodiments that (1) are enabled by this specification and (2) correspond to statutory subject matter. Non-enabled embodiments and embodiments that correspond to non-statutory subject matter are explicitly disclaimed even if they fall within the scope of the claims.

What is claimed is:

1. A prefabricated container modified as a medical isolation room, the medical isolation room comprising:

a prefabricated container having a width, a height, and a length between a front end and a back end, the length being greater than the width, the front end including an original door which is replaced by a clear front door, the container including a base having, a roof, and two side panels along the length, the container including a back wall at the back end along the width and the height;

an intake louver and an adjustable damper, disposed at a lower part of the front end adjacent the base;

an exhaust vent disposed at an upper part of the back wall adjacent the roof;

an exhaust fan coupled to the exhaust vent;

a HEPA filter coupled to the exhaust fan; and washable coverings to cover interior sides of the two side panels, the back wall, and the base to provide washable, nonslip interior surfaces;

the exhaust fan and the adjustable damper at the intake louver being controlled to produce in the medical isolation room a negative air pressure of at least about minus 0.01 inch of water gage (approximately 2.5 pascals) and a displacement ventilation exhaust flow rate through the exhaust vent of at least about 100 cubic feet per minute (cfm) greater than an intake flow rate through the intake louver.

2. The medical isolation room of claim 1, wherein the exhaust fan and the adjustable damper of the intake louver are controlled to produce an exhaust air change rate of at least 12 air changes per hour for the medical isolation room.

3. The medical isolation room of claim 1, wherein the exhaust fan and the adjustable damper of the intake louver are controlled to produce a displacement ventilation flow rate through the exhaust vent of at least about 200 cubic feet per minute (cfm).

4. The medical isolation room of claim 1, wherein the front end includes a clear front panel disposed adjacent the clear door; and wherein the intake louver is provided at a lower part of the clear front panel adjacent the base.

5. The medical isolation room of claim 4, wherein the intake louver is disposed less than about 12 inches above a floor surface of the base.

6. The medical isolation room of claim 1, wherein the exhaust vent is disposed less than about 12 inches below a ceiling of the roof.

7. The medical isolation room of claim 1, wherein the prefabricated container has a width of about 8 feet, a height of about 8 feet, and a length of about 12-16 feet; and wherein the intake louver has a width of about 12 inches and a height of about 12 inches.

8. The medical isolation room of claim 1, wherein the washable coverings to cover the interior sides of the two side panels, the back wall, and the base comprise spray-on or sheeting including FRP (fiberglass reinforced plastic), HDPE (high-density polyethylene), rubber, rolled vinyl, or aluminum.

9. The medical isolation room of claim 1, further comprising:

an access ramp disposed in front of the clear front door and including an inclined ramp surface extending from a ground below a floor surface of the base to the floor surface in front of the clear front door.

10. A plurality of the medical isolation rooms of claim 1, the medical isolation rooms being arranged side-to-side with the clear front doors all facing in a same direction and all aligned to be coplanar with each other.

11. A prefabricated container modified as a medical isolation room, the medical isolation room comprising:

a prefabricated container having a width, a height, and a length between a front end and a back end, the length being greater than the width, the front end including an original door which is replaced by a clear front door, the container including a base, a roof, and two side panels along the length, the container including a back wall at the back end along the width and the height;

an intake louver and an adjustable damper, disposed at a lower part of the front end adjacent the base;

an exhaust vent disposed at an upper part of the back wall adjacent the roof;

an exhaust fan coupled to the exhaust vent;

a HEPA filter coupled to the exhaust fan; and washable coverings to cover interior sides of the two side panels, the back wall, and the base to provide washable, nonslip interior surfaces;

the exhaust fan and the adjustable damper at the intake louver being controlled to produce in the medical isolation room a negative air pressure of at least about minus 0.01 inch of water gage (approximately 2.5 pascals) and a displacement ventilation exhaust flow rate through the exhaust vent of at least about 100 cubic feet per minute (cfm) greater than an intake flow rate through the intake louver;

the displacement ventilation exhaust flow rate through the exhaust vent being at least about 200 cfm; and the exhaust fan and the adjustable damper at the intake louver being controlled to produce an exhaust air change rate of at least 12 air changes per hour for the medical isolation room.

12. The medical isolation room of claim 11, wherein the front end includes a clear front panel disposed adjacent the clear door; and wherein the intake louver is provided at a lower part of the clear front panel less than about 12 inches above a floor surface of the base.

13. The medical isolation room of claim 12, wherein the exhaust vent is disposed less than about 12 inches below a ceiling of the roof.

14. The medical isolation room of claim 13, wherein the prefabricated container has a width of about 8 feet, a height of about 8 feet, and a length of about 12-16 feet; and wherein the intake louver has a width of about 12 inches and a height of about 12 inches.

15. A method of making a medical isolation room using a prefabricated container, the method comprising:

installing a clear front door in a prefabricated container having a width, a height, and a length between a front end and a back end, the length being greater than the width, the front end including an original door which is replaced by the clear front door, the container including a base, a roof, and two side panels along the length, the container including a back wall at the back end along the width and height;

installing an intake louver and an adjustable damper, disposed at a lower part of the front end adjacent the base;

installing an exhaust vent disposed at an upper part of the back wall adjacent the roof;

coupling an exhaust fan to the exhaust vent;

coupling a HEPA filter to the exhaust fan; and covering, with washable coverings, interior sides of the two side panels, the back wall, and the base to provide washable, nonslip interior surfaces; and controlling the exhaust fan and the adjustable damper at the intake louver to produce in the medical isolation room a negative air pressure of at least about minus 0.01 inch of water gage (approximately 2.5 pascals) and a displacement ventilation exhaust flow rate through the exhaust vent of at least about 100 cubic feet per minute (cfm) greater than an intake flow rate through the intake louver.

16. The method of claim 15, further comprising:

controlling the exhaust fan and the adjustable damper at the intake louver to produce an exhaust air change rate of at least 6 air changes per hour for the medical isolation room.

17. The method of claim 15, further comprising:

controlling the exhaust fan and the adjustable damper of the intake louver to produce a displacement ventilation flow rate through the exhaust vent of at least about 200 cubic feet per minute (cfm).

18. The method of claim 15, further comprising:

arranging a plurality of the medical isolation rooms side-to-side with the clear front doors all facing in a same front direction and all aligned to be coplanar with each other.

19. The method of claim 18, further comprising:

arranging the plurality of the medical isolation rooms side-to-side with the back walls all facing in a same back direction and all aligned to be coplanar with each other; and connecting utilities to the plurality of medical isolation rooms to share utilities among at least some of the medical isolation rooms, the shared utilities including one or more of HVAC, electrical, and power generation.

20. The method of claim 15, further comprising:

installing at the front end a clear front panel disposed adjacent the clear front door;

installing the intake louver at a lower part of the clear front panel less than about 12 inches above a floor surface of the base; and installing the exhaust vent less than about 12 inches below a ceiling of the roof.

* * * * *